US010479964B2

(12) United States Patent
Klinkhammer et al.

(10) Patent No.: US 10,479,964 B2
(45) Date of Patent: Nov. 19, 2019

(54) SHELF-ADHERING CLEANING BLOCKS AND CLEANING ARTICLES, AND METHODS OF MAKING SUCH BLOCKS AND ARTICLES

(71) Applicant: S.C. Johnson & Son, Inc., Racine, WI (US)

(72) Inventors: Michael E. Klinkhammer, Dunedin, FL (US); Russell B. Wortley, Kenosha, WI (US); Cory J. Nelson, Racine, WI (US); Ronald H. Spang, Jr., Kenosha, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 15/318,197

(22) PCT Filed: Jul. 1, 2015

(86) PCT No.: PCT/US2015/038733
§ 371 (c)(1),
(2) Date: Dec. 12, 2016

(87) PCT Pub. No.: WO2016/004150
PCT Pub. Date: Jan. 7, 2016

(65) Prior Publication Data

US 2017/0114311 A1 Apr. 27, 2017

Related U.S. Application Data

(60) Provisional application No. 62/019,764, filed on Jul. 1, 2014.

(51) Int. Cl.
*C11D 17/00* (2006.01)
*E03D 9/02* (2006.01)
(Continued)

(52) U.S. Cl.
CPC ..... *C11D 17/0056* (2013.01); *C11D 1/22* (2013.01); *C11D 1/66* (2013.01); *C11D 3/50* (2013.01);
(Continued)

(58) Field of Classification Search
None
See application file for complete search history.

(56) References Cited

U.S. PATENT DOCUMENTS 8,318,655 B1 * 11/2012 Drost ..... C11D 17/0052 264/212
2006/0178079 A1 * 8/2006 Tsutsui ..... A47K 5/04 446/73
2008/0190457 A1 * 8/2008 Veltman ..... C11D 1/143 134/22.19

FOREIGN PATENT DOCUMENTS

WO WO 2013/106372 A1 7/2013

OTHER PUBLICATIONS

PCT/US2015/038733 International Search Report and Written Opinion dated Sep. 24, 2015.
Oct. 25, 2018—(CN) Office Action—App 201580046726.1.

* cited by examiner

*Primary Examiner* — Necholus Ogden, Jr.

(57) ABSTRACT

A self-adhering cleaning block is disclosed. In some embodiments, the self-adhering cleaning block includes a first surface, a second surface opposite the first surface, and a handle extending out from a part of the second surface, where the material composition of the block may be essentially uniform, and where the material composition of the block may further comprise a non-ionic surfactant and a liquid component. In addition, a cleaning article including a self-adhering cleaning block is disclosed. Moreover, a method is disclosed. In certain examples the method com-
(Continued)

prises mixing a non-ionic surfactant and a liquid component to form an essentially uniform cleaning composition, and then extruding, pressing or casting the cleaning composition to form a cleaning block having a first surface, a second surface opposite the first surface, and a handle extending out from a part of the second surface.

14 Claims, 7 Drawing Sheets

(51) Int. Cl.
*C11D 1/22* (2006.01)
*C11D 1/66* (2006.01)
*C11D 3/50* (2006.01)
(52) U.S. Cl.
CPC ..... *E03D 9/022* (2013.01); *E03D 2009/024* (2013.01)

SHELF-ADHERING CLEANING BLOCKS AND CLEANING ARTICLES, AND METHODS OF MAKING SUCH BLOCKS AND ARTICLES

CROSS-REFERENCE TO RELATED APPLICATIONS

This application represents the U.S. National Stage of International Application No. PCT/US2015/038733, filed Jul. 1, 2015, which is based on, claims priority to, and incorporates herein by reference in its entirety. U.S. patent application Ser. No. 62/019,764 filed on Jul. 1, 2014. The entire disclosure is hereby incorporated by reference. The present disclosure is related to U.S. patent application Ser. No. 11/673,661, now U.S. Pat. No. 7,709,433, U.S. patent application Ser. No. 12/388,576, now U.S. Pat. No. 8,143,205, and U.S. application Ser. No. 13/374,700, now U.S. Pat. No. 8,658,588, each of which are incorporated by reference in their entirety as if set forth fully herein.

TECHNICAL FIELD

The present disclosure generally relates to self-adhering cleaning blocks, cleaning articles and methods, for example methods of making a self-adhering cleaning block.

BACKGROUND

Agents for cleaning, sanitizing, and deodorizing surfaces of bathroom appliances such as toilets can be in the form of solids, pastes, gels, powders and liquids. Liquid formulations delivered in squeeze bottles allow for periodic cleaning of the appliance and typically require a consumer to reapply the sanitary agent each time the appliance is to be cleaned. Other products that demand less time by the consumer allow for automatic or continuous cleaning of the appliance.

For example, disintegrating blocks containing various components can be used for cleaning, disinfecting and/or deodorizing toilets or urinals. Such disintegrating blocks generally are immersed in the water tank (also known as the cistern) of a toilet or urinal, or are placed in a holder of some sort and then put "under-the-rim" (UTR) of the toilet bowl or urinal. Once put into place, either in the cistern or in the toilet bowl or urinal, the block slowly releases active ingredients and disintegrates into the water. In the case of a disintegrating block placed into the cistern, the block may fall to the bottom of the cistern, and then constantly be bathed with water. Such constant contact with the water requires a formulation of a certain type to ensure that the disintegrating block releases active ingredients and disintegrates at an appropriate rate. In the case of UTR products, such disintegrating blocks will disintegrate and release active ingredients each time that the toilet is flushed and the block is rinsed with the flush water. Many of the disintegrating blocks described in the patents noted above may be placed into the toilet tank (cistern), either by placing the block into a dispenser, or by simply placing the block in the tank.

Automatic or continuous cleaning may also afforded by suspending a sanitary agent in baskets that hang from the appliance or toilet rim. Relatedly, continuous cleaning may be afforded by self-adhering UTR agents in the form of solid blocks that are attached to the surface of the toilet.

SUMMARY

This Summary provides an introduction to some general concepts relating to this disclosure in a simplified form that are further described below in the Detailed Description. This Summary is not intended to identify key features or essential features of the disclosure.

Aspects of the disclosure herein relate to self-adhering cleaning blocks, cleaning articles and methods, for example methods of making a self-adhering cleaning block. In accordance with one exemplary aspect, a self-adhering cleaning block is disclosed. In some examples, the cleaning block may include a first surface, a second surface opposite the first surface, and a handle extending from a part of the second surface. In various examples, the material composition of the block is essentially uniform. In certain embodiments, the material composition of the block may include a non-ionic surfactant and a liquid component. In various examples, the material composition includes a solid anionic surfactant. In some examples, a self-adhering agent or cleaning block that does not utilize a disposable applicator, but at the same time allows the user to apply the block without bringing their hand into close proximity to the surface of a toilet is provided.

BRIEF DESCRIPTION OF THE DRAWINGS

Exemplary embodiments of the disclosure will now be described by way of example only and with reference to the accompanying drawings, in which.

DETAILED DESCRIPTION OF EMBODIMENTS

Figure 1:
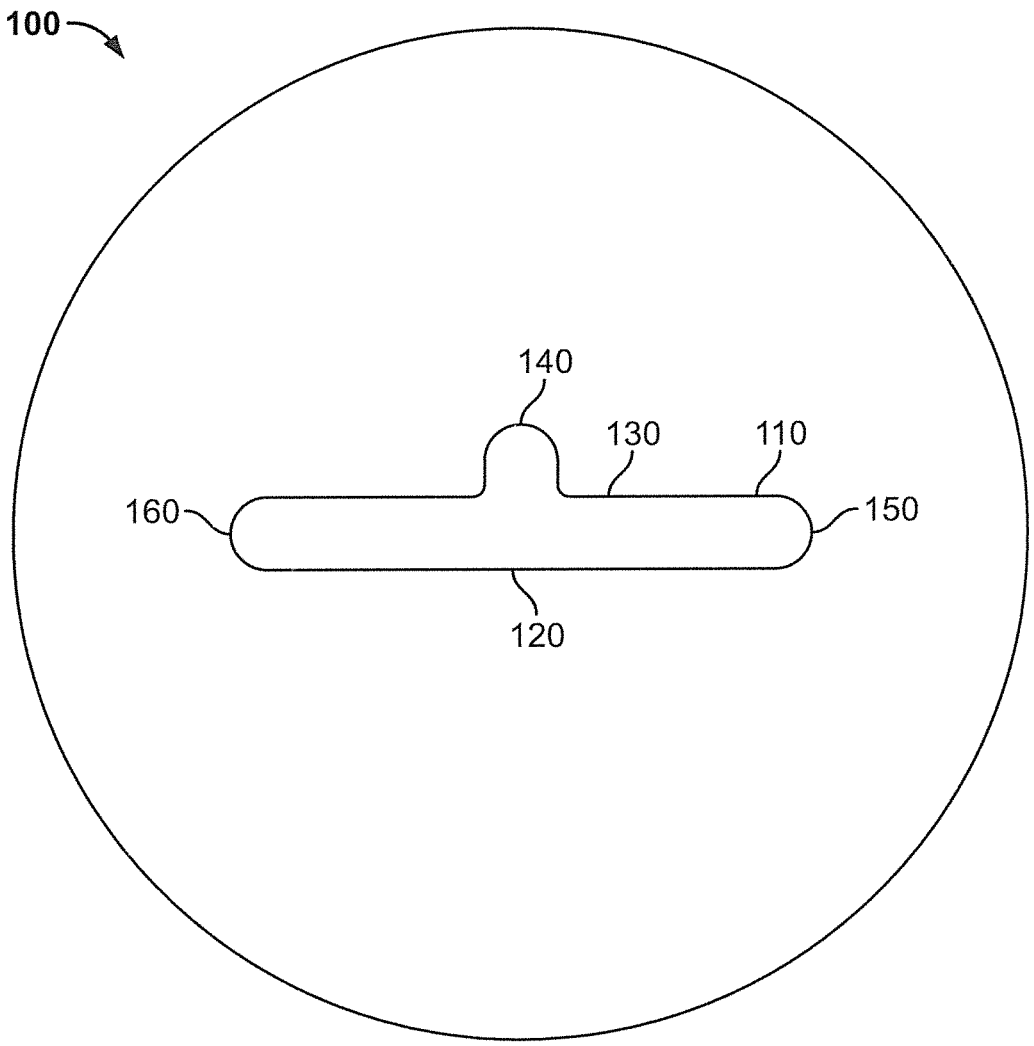
FIG. 1 illustrates an example extruder die that may be used in one or more embodiments of the method.

In the following description of various example structures in accordance with the disclosure, reference is made to the accompanying drawings, which form a part hereof, and in which are shown by way of illustration of various structures in accordance with this disclosure. Additionally, it is to be understood that other specific arrangements of parts and structures may be utilized, and structural and functional modifications may be made without departing from the scope of the present disclosure.

The embodiments, apparatuses and methods described herein provide self-adhering cleaning blocks, cleaning articles and methods, for example methods of making a self-adhering cleaning block. These and other aspects, features and advantages of the disclosure or of certain embodiments of the disclosure will be further understood by those skilled in the art from the following description of exemplary embodiments.

Some aspects of the disclosure relate to a self-adhering cleaning block which can be configured to adhere to a surface to be cleaned, such as a toilet surface. In certain examples, the cleaning block can include a first surface, which can be adhered to the surface desired to be cleaned, a second surface opposite the first surface, and an optional handle extending out from a part of the second surface. During use, the user can apply the self-adhering cleaning block to the surface desired to be cleaned by grasping a portion of the cleaning block or by using the optional handle and placing the first surface into contact with the surface desired to be cleaned to adhere the cleaning block to the surface. In this way, when water is flushed or rinsed over the surface, the block administers a cleaning agent by dissolving incrementally after each flush or rinse.

In some examples, the block comprises one or more side surfaces joining the first and second surfaces. The block may be a variety of shapes and sizes. For example, in some embodiments the first and second surfaces, and one or more side surfaces define a block body (i.e. the non-handle portion of the block), where in some embodiments the block body has the shape of a prism (including, but not limited to a triangular prism or a rectangular prism), a cylinder, a cone, a sphere, an ellipse, or a section of such a shape.

In various embodiments, the first and second surfaces are parallel to each other, and in others they are substantially parallel (i.e. having a difference of ten degrees or less in relative orientation). In some examples, the first and second surfaces have an identical perimeter shape. In certain of these examples, the first and second surfaces are an identical size as well, while in others one surface is a smaller but proportional size. In some examples, the first and second surfaces have a geometric, circular, irregular, undulating, or an elliptical perimeter shape. In certain embodiments, such as those where the blocks are produced via extrusion, as described below, the first surface, second surface and any side surfaces have a consistent profile along the axis of extrusion. In some examples, the shape of the body of the block, i.e. the non-handle portion of the block, is convex, and in others it is concave. In certain examples, one of the first or second surfaces is convex, and in others one of the first or second surfaces is concave. In some examples, an edge formed between two or more surfaces may be angled, while in others the edge may be curved. As discussed in more detail below, in certain examples the block is formed via extrusion, casting, and or pressing processes, and thus a wide variety of shape and/or profiles are possible depending on the desired properties of the block, and the die, cone, plate and/or mold used.

Figure 6:
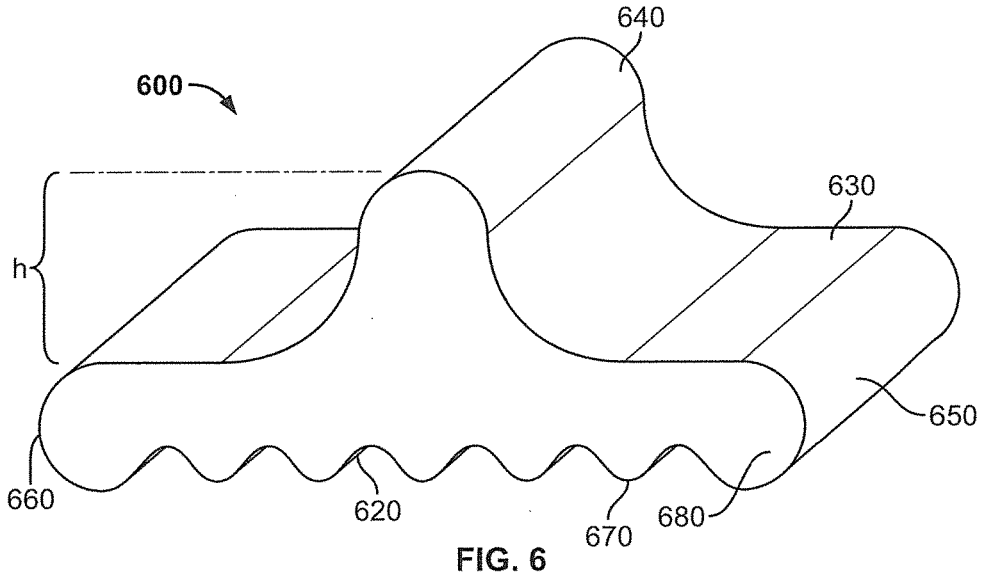
FIG. 6 illustrates a perspective view of an example cleaning block.

FIG. 6-10 provide example cleaning blocks, which are configured to be applied to a surface desired to be cleaned without the use of an applicator. FIG. 6 provides an example cleaning block 600 having a first surface 620, a second surface 630, and a handle 640. In this example, the first surface 620 has a plurality of projections 670 extending out of the first surface 620, as described in more detail below. The example cleaning block 600 further includes a first, second, and third side surfaces 650, 660, and 680, as well as a fourth side surface (not seen from this view), where in this example the third surface 680 and the fourth side surface have the same profile shape (as does any intermediate section of the block between the two surfaces). The cleaning block 600 provides an example of a block that may be formed by an extrusion process and having a consistent profile shape from being forced through an extrusion die having the same shape. In some embodiments, however, cleaning blocks having a consistent profile shape may be made from other processes, such as a casting process, or a pressing process.

Figure 3:
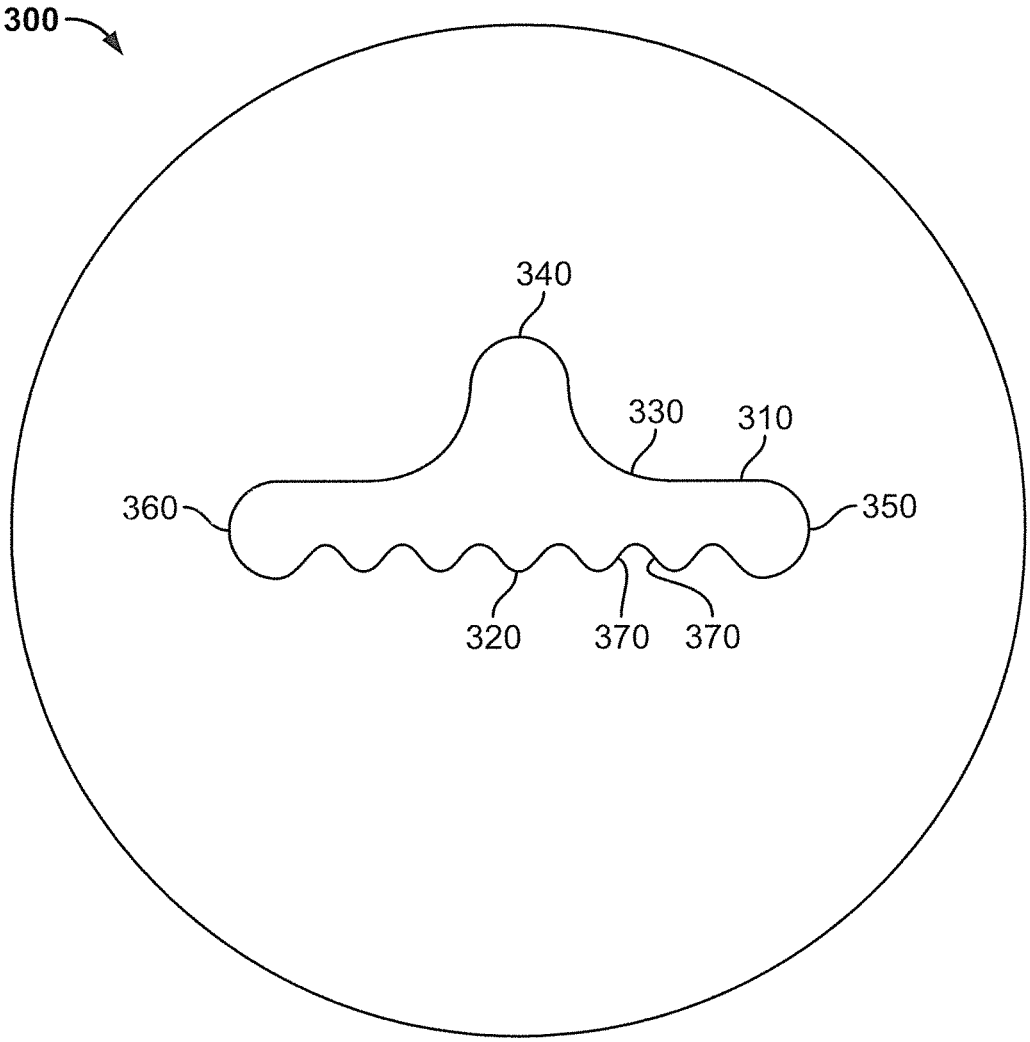
FIG. 3 illustrates an example extruder die that may be used in one or more embodiments of the method.
Figure 4:
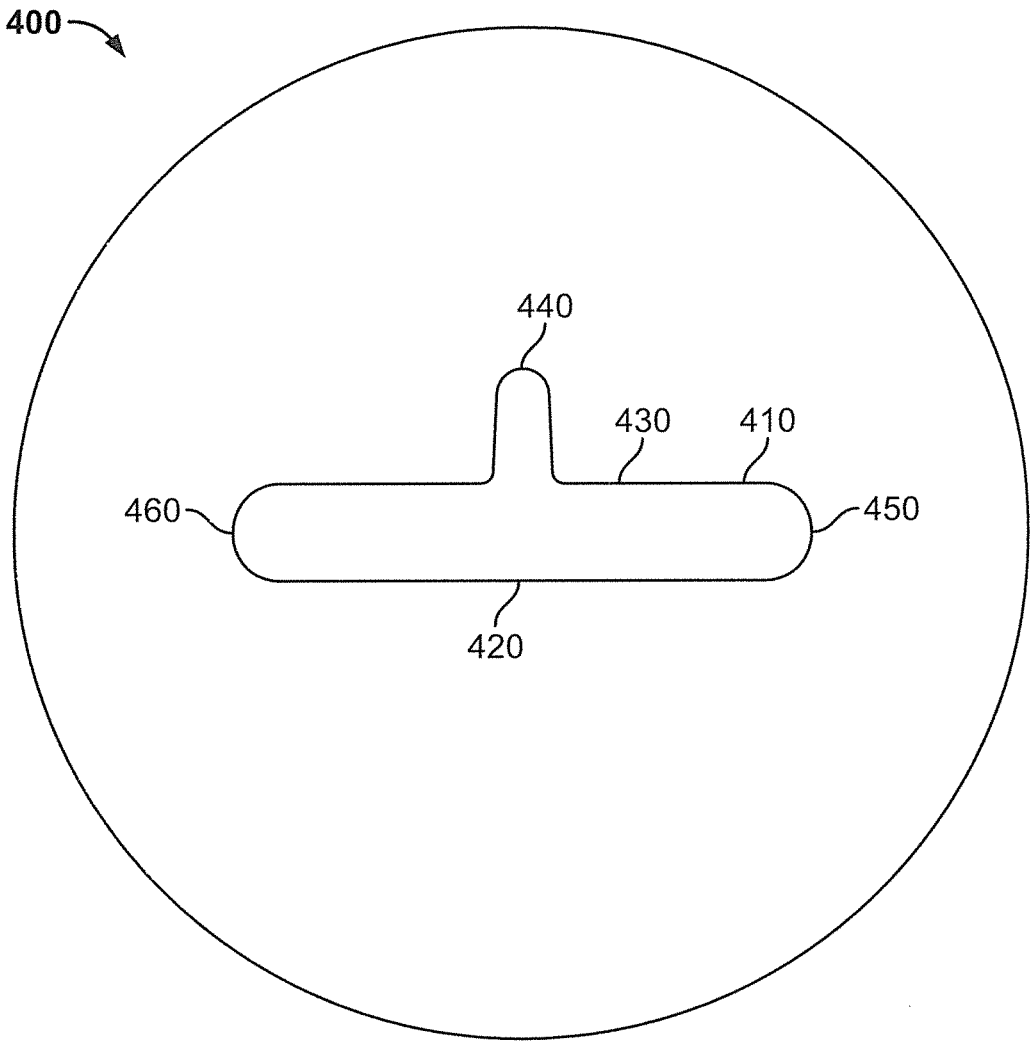
FIG. 4 illustrates an example extruder die that may be used in one or more embodiments of the method.
Figure 5:
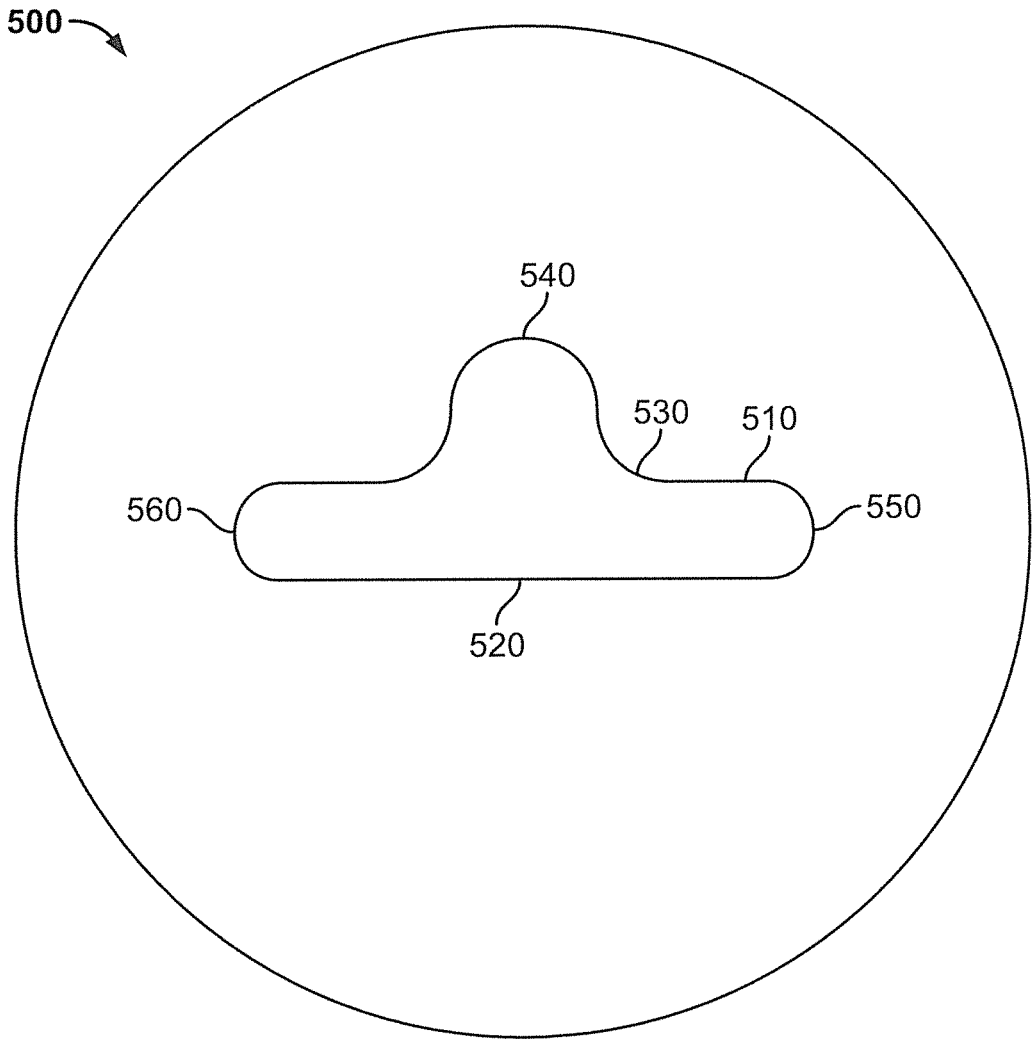
FIG. 5 illustrates an example extruder die that may be used in one or more embodiments of the method.

In certain examples, the plurality of projections 670 are one or more ridges traversing the entire first surface, for example a plurality of profile ridges resulting from an extrusion process using the extruder die depicted in FIG. 3. The plurality of projections 670 may vary in number, size and shape as needed or desired to influence the adherence characteristics of the cleaning block 600. As shown in FIG. 1, the projections 670 can be formed triangular or pyramidal. However in other alternative examples, the plurality of projections can be formed circular or square. The shape of the plurality of projections may be regular or irregular. In certain examples, the plurality of projections may vary in size, for example one or more projections on or near the perimeter of the first surface may extend further from the surface than one or more projections closer to the interior. In some examples, the entire perimeter of the first surface is raised and acts as a projection. In various examples, the perimeter of one or more sides is raised relative to the first surface and acts as the one or more projections, for example in embodiments where the first surface is concave. When the user applies the cleaning block to a surface to be cleaned, for example when holding the handle of the block, the user may press down on the block and cause the plurality of projections to deform against the surface to be cleaned. Thus, in some examples the projections adhere to the surface to be cleaned, and in certain examples facilitate the adhesion to the surface, including a wet surface.

Figure 7:
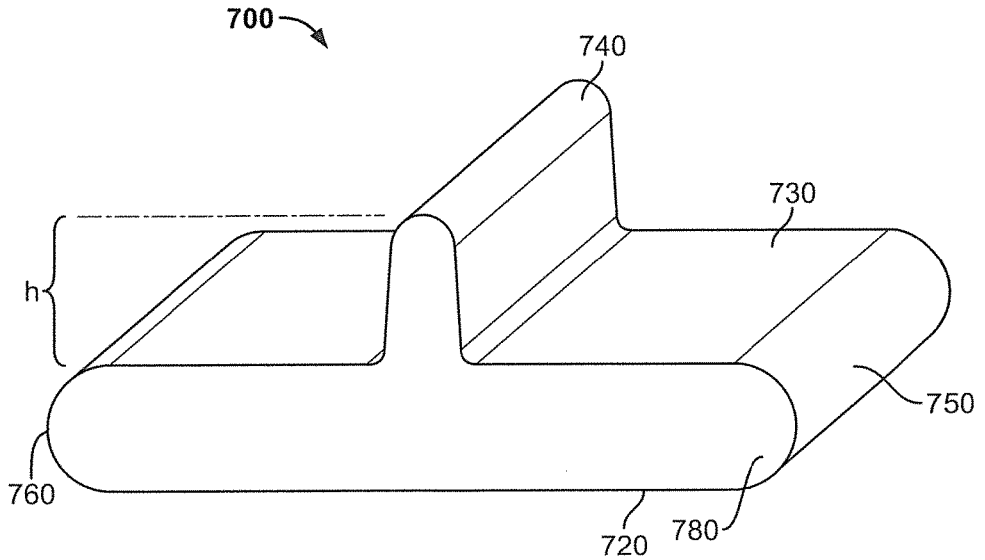
FIG. 7 illustrates a perspective view of an example cleaning block.

FIG. 7 provides another example block 700 having a first surface 720, a second surface 730, a handle 740, and first, second, and third side surfaces 750, 760, and 780, as well as a fourth side surface (not seen from this view). Block 700 provides another example of a block that may be formed by an extrusion process using the extruder die depicted in FIG. 2 and having a consistent profile shape from being forced through the extrusion die shown in FIG. 2, which has the same profile shape.

Figure 8:
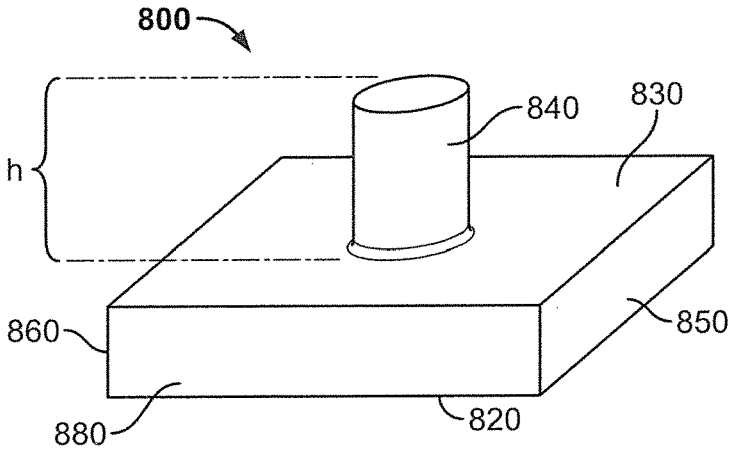
FIG. 8 illustrates a perspective view of an example cleaning block.

FIG. 8 provides another example block 800 having a first surface 820, a second surface 830, a handle 840, a first side surface 850, a second side surface 860 and a third side surface 880, as well as a fourth side surface (not seen from this view). Block 800 provides an example of a block that may be formed by casting process, and therefore not having a consistent profile shape. For example, block 800 has a handle extending out of a middle portion of its second surface 830 rather than a portion spanning the entire surface.

In various examples, such as the examples shown in FIGS. 6-8, the block may include a handle extending out from a part of the second surface. The handle may take any shape, form or size that allows a user to grasp and/or manipulate the block via the handle. As shown in FIGS. 6 and 7, the handle can be a ridge extending out of a portion of the second surface, where the ridge may traverse the entire second surface or only a portion thereof. In certain embodiments, the ridge may be curved or circular, including an outline of a circle, such that a user may easily grab at least of a portion of the ridge regardless of their orientation to the cleaning block. In other examples the ridge can be a raised "X" shaped structure, or some other geometric shape. In the example shown in FIG. 8, the handle can be a protrusion or other feature, such as a single cylinder, extending out from one area of the second surface, such as the middle of the surface. In other examples the handle can be a single parabolic shaped formation, or a single geometric prism shape, such as a rectangle or triangle shape. In other examples, the handle shape can be irregular. In various examples, the block may include multiple handles. In certain embodiments, one or more handles and/or one or more surfaces of the block may have indentations or divots shaped and sized to receive a user's finger or fingers.

As depicted in the examples shown in FIGS. 6-8, the handle has a handle height h as compared to the second surface. In certain examples, the handle height h may be measured between a portion of the second surface adjacent to the handle and a top portion of the handle, while in other examples, the height may be measured between the lowest relative portion of the second surface as compared to a top portion of the handle. The handle height may be any height that allows a user to grasp and/or manipulate the block. In some examples, the ability to grasp and/or manipulate the handle allows the user to apply the block to a surface to be cleaned without bringing their hand as close to the surface. This may allow the user to comfortably use more force and achieve better adhesion onto the surface. Among other things; this also allows a low cost product that is convenient and in many ways environmentally friendly, since the disintegrating cleaning block eliminates the need to use a plastic disposable cage or a disposable plastic applicator currently used by other UTR products.

In certain embodiments, the handle height is about 0.20 inches or more. In various examples, the handle height is about 0.30 inches or more, about 0.40 inches or more, about 0.50 inches or more, or about 0.75 inches or more. In some examples, the handle height is between about 0.15 inches and about 0.25 inches, in others between about 0.20 inches and about 0.30 inches, and in other between about 0.30 inches and 0.50 inches.

In various embodiments, the handle, by extending out from the second surface when the first surface is adhered to a surface to be cleaned, such as a toilet surface, generates increased water shear in the flush water flowing over the block when the toilet is flushed. This in turn generates additional foam during the flush cycle and may enhance the cleaning ability of the block and any surfactants contained therein.

Figure 9:
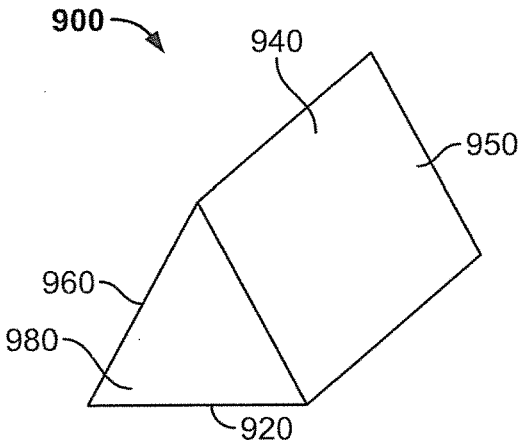
FIG. 9 illustrates a perspective view of an example cleaning block.

FIG. 9 provides another example block 900 having a first surface 920, a first and second side surfaces 950, 960 forming a triangular shape with the first surface, and a third side surface 980, as well as a fourth side surface (not seen from this view). In this example, a user may grasp the first and second side surface surfaces 950, 960 about their intersection, where this area may function as a handle 940, and place the first surface against the surface to be cleaned.

Figure 10:
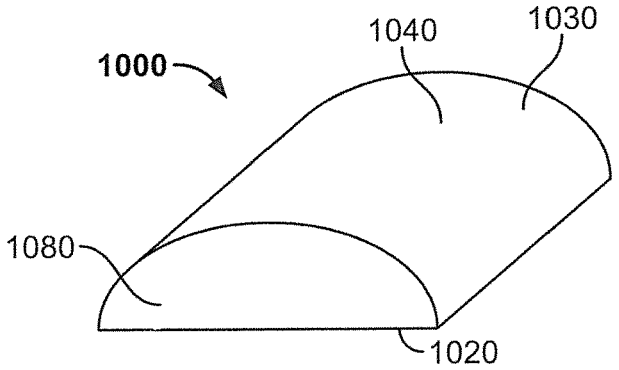
FIG. 10 illustrates a perspective view of an example cleaning block.

FIG. 10 provides another example block 1000 having a first surface 1020, a second surface 1030, and a first side surface 1080 and a second side surface (not seen). In this example, a user may grasp the rounded portion of the block formed by the curved second surface, where this area may function as a handle 1040.

In some embodiments, such as in FIGS. 9 and 10, the shape of one or more surfaces of the block functions as a handle or a grasping portion. For example, as shown in FIG. 9, the block may comprise two side surfaces 950, 960 joined to each other and the first surface to essentially define a triangular prism. In these examples, the user may grasp the two side surfaces about their intersection and place the opposing face of the prism against the surface to be cleaned. In other examples, the block may have an essentially pyramidal shape, (including but not limited to a triangular, square, or hexagonal pyramid) and the user may grasp the block about the vertex of the side faces and orient the base of the pyramid into contact with the surface to be cleaned. For example, as in FIG. 10, the second surface 1030 of the block 1000 may be rounded such that a user can grasp the rounded portion easily. In these examples, the block first surface can be configured to adhere to a surface to be cleaned, and then one or more surfaces are configured to function as the handle.

In other examples, the shape of the block may be essentially rectangular, or another geometric prism, where the size of the surfaces are such that a user may grasp and/or manipulate the prism so that a facial surface may be pressed against a surface to be cleaned. In other examples the surface to be pressed against the surface to be cleaned is not facial, for example a surface having one or more projections. In some of these examples, the size of the various surfaces are such that the user may grab the side surfaces of the prism that connect the defining geometric shapes. In other examples, the one or more side surfaces may connect an irregular or non-geometric shape, but are sized such that a user may grasp the block by the side surfaces and adhere another surface of the block to a surface to be cleaned.

The self-adhering block may be any size suitable for use in cleaning a surface, including surfaces such as a toilet or urinal, and where there is sufficient surface area to self-adhere to the surface to be cleaned. In some examples, the first surface adheres to the surface to be cleaned, for example by being pressed against the surface by a user holding the handle, and thus the surface area of the first surface must be sufficient to allow self-adhesion and future retention of the block in its position. Thus, the block can function as a continuous toilet bowl cleaner.

In some embodiments, the block height (as measured between a bottom portion of the first surface and a top portion of the handle) and the block width (for example, as measured between opposing sides of the block, such as a first side and a second side of the block, or for example as measured between opposing side surfaces of the first surface, such as a first side surface and a second side surface), have a height to width ratio between about 1:4 and about 4:1. In some examples, the ratio is between about 1:1 and 1:8, in others about 1:8 and 8:1, in others about 1:2 and 2:1, in others about 1:3 and 3:1, and in still others about 1:1 and 8:1. In certain examples, the block height is about 0.20 inches or more. In various examples, the block height is about 0.30 inches or more, about 0.40 inches or more, about 0.50 inches or more, or about 0.75 inches or more. In certain examples, the block height is between about 0.15 inches and about 0.25 inches, in others between about 0.20 inches and about 0.30 inches, and in other between about 0.30 inches and 0.50 inches.

In certain examples, the ratio of block width and height, and/or the ratio of surface area to volume may be altered to control the rate of block disintegration, and thus length of life and the amount of block components released during each flush. For example, altering the dimensions of the shape of the block, or the shape of the block itself (e.g. from a triangular prism to a shape having more surface area, such as a cylinder) will alter the relevant ratios. Higher ratios of surface area to volume provides greater foaming upon each flush and the release of a relatively larger amount of the components of the block, including and cleaning surfactants, fragrances and the like. At the same time, this will lead to a relatively shorter length of life. Conversely, a lower ratio provides a longer length of life, with relatively less foaming and release of the compounds of the cleaning block.

The material composition of the block may vary depending on the adhesion, disintegration, and length of life properties desired. In some embodiments, the material composition may comprise the chemical compositions described in more detail below, or described in any of the related applications referenced above. In certain examples, the material composition of the block is essentially uniform. In various examples, the material composition of the block comprises a non-ionic surfactant and a liquid component. In certain examples, the material composition of the block comprises a solid anionic surfactant, a non-ionic surfactant and a liquid component.

These descriptions of the self-adhesive cleaning block are merely exemplary. In certain embodiments, the cleaning block comprises additional combinations or substitutions of some or all of the components described above. Moreover, additional and alternative suitable variations, forms and components for the cleaning block will be recognized by those skilled in the art given the benefit of this disclosure.

Other aspects of the disclosure relate to a cleaning article. In certain embodiments, the cleaning article comprises a self-adhering cleaning block. In various embodiments, the cleaning block of the cleaning article may comprise any of the components and/or features described above in reference to the self-adhering cleaning block aspects of the disclosure.

In some examples, the article further comprises a barrier layer covering at least a portion of the handle of the cleaning block. In some examples, the barrier layer comprises one or more water soluble materials. In certain embodiments, the water soluble materials are materials that disintegrate or dissolve in the presences of water, for example water running over the material from flushing. In certain examples, the materials comprise one or more water-soluble polymers, including but not limited to poly-vinyl alcohol and/or cellulose ether. In various embodiments, additives can be incorporated into the water-soluble polymers to alter disintegration and dissolution as desired. In certain examples, the water soluble materials comprise a biodegradable or other environmentally compatible material. In various examples the barrier layer is toilet paper. Therefore, in certain examples, upon contact with water, such as through flushing, the barrier layer will dissolve or disintegrate to fully expose the self-adhesive material of the cleaning block. In certain embodiments, the barrier also covers to at least part of the block body, including one or more of the first surface, second surface, one or more side surfaces, and/or one or more projections. In various examples, the barrier layer covers the entire handle or substantially all of the handle.

In various embodiments, the barrier layer is releasably adhered to the at least a portion of the handle, such that a user may remove the barrier layer after applying the self-adhering cleaning block to a surface to be cleaned. In some embodiments, the releasably adhered barrier layer is wax paper or silicone coated paper. In certain embodiments, the barrier may be releasably adhered to at least part of the block body, including one or more of the first surface, second surface, one or more side surfaces, and/or one or more projections. In various examples, the barrier layer is reliably adhered to the entire handle or substantially all of the handle before it is removed.

In certain examples, the article comprises at least a second barrier layer. In some examples, at least a second barrier layer covers at least a portion of the first surface and/or the plurality of projections, and the user removes the layer before adhering the block to a surface to be cleaned.

These cleaning article descriptions are merely exemplary. In certain embodiments, the cleaning article comprises additional combinations or substitutions of some or all of the components described above. Additional and alternative suitable variations, forms and components for the cleaning article will be recognized by those skilled in the art given the benefit of this disclosure. Moreover, any of the features discussed in the exemplary embodiments of the cleaning block may be features of embodiments of the cleaning article described above, and vice versa.

Other aspects of the disclosure relate to a method, including methods of making a self-adhering cleaning block and/or a cleaning article comprising such a block. The method examples may include any steps that result in the formation of the examples of the cleaning block and/or cleaning article examples described above, or any other blocks having a handle that allows a user to grasp and/or manipulate the cleaning block. In certain examples, the method comprises extrusion, pressing, and/or casting processes to form a block having the desired final shape.

In some examples, the block may be extruded, pressed, or cast into a unit comprising multiple cleaning blocks joined by one or more breakable connections. In certain embodiments, the extruded log or the cut portion of the log is large enough to provide multiple cleaning blocks, and the block is partially cut or scored to provide one or more breakable connections that allow a user to break off a smaller unit to use as a cleaning block. In certain examples, the shape of the die or cone provides a log with an extrusion profile that includes one or more areas having a relatively small thickness, as compared to the rest of the block and/or log, that may function as a breakable connection. In some examples, the log of extrude provides a block designed to be broken into two or more individual cleaning blocks, in others four or more individual cleaning blocks, in others six or more individual cleaning blocks, and in still others eight or more individual cleaning blocks.

In certain examples, the method comprises mixing two or more chemical components to form a cleaning composition. In various embodiments, the cleaning composition is essentially uniform after the mixing. In some examples, at least a non-ionic surfactant and a liquid component are mixed. In various embodiments, a solid anionic surfactant is mixed with a non-ionic surfactant and a liquid component. The method may then include extruding, pressing or casting the cleaning composition to form a cleaning block. In certain examples, the formed cleaning block has a first surface, a second surface opposite the first surface, and a handle extending out from a part of the second surface. In some examples, the composition is melted and casted in a mold having the desired shape. In other examples, the mixed composition is pressed into a solid or substantially solid product using a mold having a desired shape.

In certain examples, the composition is extruded into a final cleaning block product. In various embodiments, the cleaning composition is extruded through a die, plate or cone to form a log, and the method further comprises cutting the log into multiple sections to form a plurality of cleaning blocks.

In some examples, the two or more chemical components are mixed until an essentially uniform damp powder or agglomerate mixture is formed. The ingredients may then be passed through an extruder one or more times. For example, the ingredients can initially be passed through the extruder to form fat pieces of spaghetti-like strands (i.e. "noodles") of the combined ingredients. Such spaghetti-like strands can then be brought together and extruded into a log having the desired shape, for example by being forced thorough an extrusion die having a particular shape after the stands are brought together. Once extruded into a log or strip, the log or strip can then be sliced using a flying knife into cylindrical disks, rectangles, squares or other consistent shapes of appropriate widths and weight, or sliced using a cutting wheel for the correct length. While cylindrical disks and rectangles are specifically described in this paragraph, other shapes are possible as described above. In certain examples, each disk or shape weighs about 20 to 25 grams, while in others about 15 to about 30 grams. In some embodiments, a Sigma Lab extruder may be used.

Figure 2:
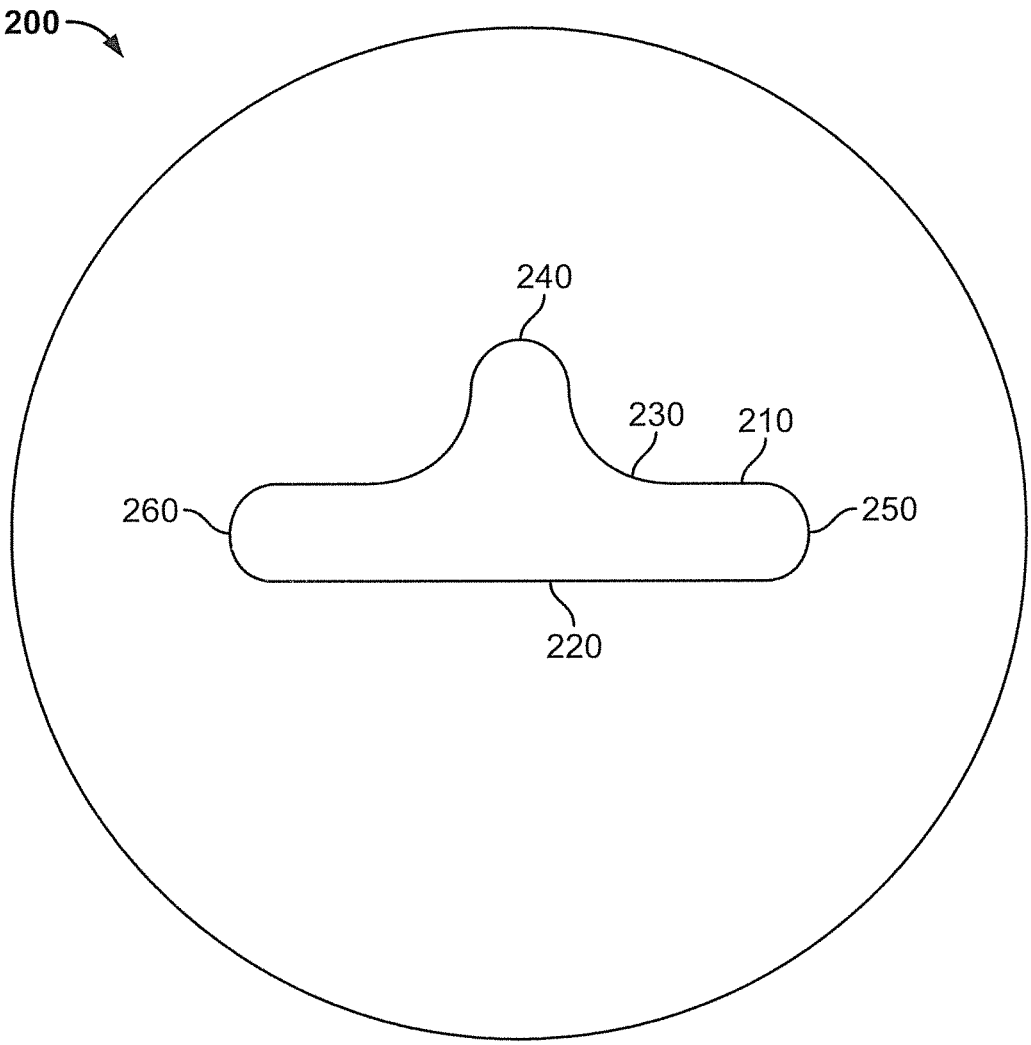
FIG. 2 illustrates an example extruder die that may be used in one or more embodiments of the method.

In some examples, the extruded product may be passed once through the "noodle" stage of the extruder, and then one or more times through a final extrusion to provide the final shape, for example two times or more, or three times or more. After the final extrusion(s), in some examples the cleaning block is in the form of a very uniform log having a certain side profile shape. FIGS. 1 through 5 provide example extruder dies that may be used in the embodiments of the method to provide cleaning blocks having the profiles corresponding to the example dies. For example, FIG. 1 provides an example extrusion die 100 having an extrusion profile shape 110 that is defined by a bottom surface edge 120, a top surface edge 130, a handle surface edge 140, and first and second side edges 150 and 160. Similarly, FIG. 2 provides an example extrusion die 200 having an extrusion profile shape 210 that is defined by a bottom surface edge 220, a top surface edge 230, a handle surface edge 240, and first and second side edges 250 and 260, and so on for FIGS. 3-5 where like reference numerals represent like components. The example die of FIG. 3 further includes a plurality of projection edges 370 that define a portion of the bottom surface edge 320.

In certain of these examples, the chemical components are mixed into a mixture, and then extruded to form "noodles" of material that are then passed through extruder dies, such as the dies of FIGS. 1-5. In these examples, the extruded product will have a shape corresponding to the shape of the die. For example, FIG. 6 shows an example extruded product resulting from the example die 300 provided in FIG. 3. In this example, the extrusion die 300 has an overall profile shape 310. The features of the profile shape and its defining edges define the profile characteristics of the resulting extruded product shown in FIG. 6, i.e. a block 600 having, e.g., a handle 640 that is defined by the handle edge 340, and a plurality of projections 670 extending from a first surface 620 that are defined by the first surface edge 320 and projection edges 370.

In various examples, the extrusion is conducted through a nose cone without the use of a die. In other examples, an extrusion die is used. In certain examples, the extrusion is conducted without the use of a die smaller than about 1 centimeter in diameter. In some examples, the disintegrating cleaning block is an extruded disk cut to a predetermined thickness (e.g., approximately one centimeter) such that the cleaning block can be placed onto the toilet or urinal wall simply by it pressing onto the surface. In some examples, the block has different thicknesses, including but not limited to approximately 0.75 centimeters, approximately 1.25 centimeters, and approximately 1.50 centimeters.

In some examples, the extrusion process is continuous (and e.g knife or blade is used to produce the individual cutting blocks from the continuous log) while in others it is semi-continuous, and forms numerous discrete blocks. In certain embodiments, the extrusion is direct extrusion.

In certain examples, the method further comprises releasably adhering a barrier layer to at least a portion of the handle. The releasably adhered barrier layer, in some examples, may comprise one or more of any of the releasably adhered barrier layer materials described above, including but not limited to wax paper and/or silicone coated paper. For example, a piece of wax paper may be pressed against the handle to adhere it to the handle (where the adhesive characteristics of the cleaning block composition may provide the adherence), while in some examples an additional adhesive is applied before the barrier layer to releasably adhere.

In some examples, the method further comprises coating at least a portion of the handle with a barrier layer comprising one or more water soluble materials. The coated barrier layer, in some examples, may comprise one or more of any of the coating barrier layer materials described above, including but not limited to one or more water soluble materials.

In certain examples, the method further includes enclosing one or more cleaning blocks in a product package. In certain examples, a number of cleaning blocks and/or articles are enclosed in a single package, where the blocks may be stacked onto each other. In some examples, the blocks or articles may be divided by additional packaging so that the blocks and/or articles do not stick together. In some examples, the container may comprise ridges, walls, cavities or other dividing features. In others, a separating substrate or layer, such as a layer of wax paper, is placed between each block before or during packaging so that multiple blocks do not stick together. In certain embodiments, the blocks and/or articles are individually wrapped and placed in the same container. In various examples, four or more cleaning blocks are packaged in a single package, in others five or more, in others six or more, and in still others eight or more.

These method descriptions are merely exemplary. In certain embodiments, the method may include additional combinations or substitutions of some or all of the steps described above. Moreover, additional and alternative suitable variations, forms and components for the method will be recognized by those skilled in the art given the benefit of this disclosure.

The cleaning block embodiments, whether standing alone or as part of a cleaning article, may comprise a variety of material components. Certain exemplary compositions, properties thereof, and uses thereof are described below. The following descriptions apply to at least some embodiments of the cleaning blocks, but may not apply to others.

In certain examples, the cleaning block includes 25% to 99% of a solid surfactant, and 1% to 25% of a liquid component, wherein all percentages are percent by weight of the total composition of the cleaning block. The liquid component may selected from water, surfactants, glycerin, fragrances, colorants, alcohols, binders, lime-scale removing agents, hydrotropes, solvents, chelating agents, dispersing agents, and mixtures thereof. The cleaning block may further include a filler. In certain examples, the cleaning block is a paste or has a paste-like consistency. In some examples, the cleaning block contains proportions of the above-identified ingredients such that the final block is solid and has a mass that has a "sticky" consistency. In certain embodiments, the cleaning block does not flow, i.e., the block is not viscous.

The ratio of the solid surfactant and the liquid component may depend on the liquid and its penetration (liquid absorption into the solid) and the solubility of the solid surfactant in the liquid(s). For a liquid fragrance, it may desirable to absorb more than solubilize. The cleaning block may include one or more solid surfactants, and optionally one or more liquid surfactants. The surfactants may be anionic, nonionic, cationic and/or amphoteric depending on the cleaning properties desired. The cleaning block may include about 25-99 wt. % of solid surfactant, and in some examples include about 40-95 wt. % of solid surfactant, and in various examples about 50-90 wt. % of solid surfactant. In some embodiments, the solid surfactant provides adherence to a surface. For greater foaming, a higher solid surfactant level may be employed, such as at least 70%. For increased longevity, lower solid surfactant levels, such as 40% and less, may be employed.

If present, the liquid surfactant may be included in the cleaning block at levels up to 25 wt. %, and in some examples up to 15 wt. %, and in various examples up to 10 wt. %. In some examples, liquid surfactants increase solubility of the block, which increases foam and releases more fragrance per flush. (All weight percents are percent by weight of the total cleaning block composition.) Suitable anionic surfactants include alkali metal salts of alkyl, alkenyl and alkylaryl sulfates and sulfonates. Some such anionic surfactants have the general formula $RSO_4M$ or $RSO_3M$, where R may be an alkyl or alkenyl group of about 8 to about 20 carbon atoms, or an alkylaryl group, the alkyl portion of which may be a straight-chain or branched-chain alkyl group of about 9 to about 15 carbon atoms, the aryl portion of which may be phenyl or a derivative thereof, and M may be an alkali metal (e.g. sodium, potassium or lithium). M may also be a nitrogen derivative (e.g. amino or ammonium).

In certain examples, the solid anionic surfactants include sodium lauryl sulfate, sodium lauryl ether sulfate and sodium dodecyl benzene sulfonate. In some examples, the solid anionic surfactant is a sodium dodecyl benzene sulfonate sold commercially as "UFARYL" DL85 by Unger Fabrikker, Fredistad, Norway. Another example solid anionic surfactant is powdered sodium lauryl sulfate sold as Stepanol® ME-Dry by Stepan. Another example solid anionic surfactant is powdered sodium ($C_{14}$-$C_{16}$) olefin sulfonate sold as Bio-Terge® AS-90B by Stepan. Other example anionic surfactants are sulfosuccinates. Useful liquid anionic surfactants can also be added; including but not limited to sodium lauryl ether sulfate, sodium lauryl sulfate, sodium alkyl aryl sulfonate. In certain embodiments, water may be added, although in some embodiments no water is added. Example nonionic surfactants include alkylpolyglycosides, such as those available under the tradename GLUCOPON from Henkel, Cincinnati, Ohio, USA.

The alkylpolyglycosides may have the following formula: $RO—(R'O)_x—Z_n$, where R is a monovalent alkyl radical containing 8 to 20 carbon atoms (the alkyl group may be straight or branched, saturated or unsaturated), O is an oxygen atom, R' is a divalent alkyl radical containing 2 to 4 carbon atoms, for example ethylene or propylene, x is a number having an average value of 0 to 12, Z is a reducing saccharide moiety containing 5 or 6 carbon atoms, for example a glucose, galactose, glucosyl, or galactosyl residue, and n is a number having an average value of about 1 to 10. For a detailed discussion of various alkyl glycosides see U.S. Statutory Invention Registration H468 and U.S. Pat. No. 4,565,647, which are incorporated herein by reference along with all other documents cited herein. Some example GLUCOPONS are as follows (where Z is a glucose moiety and x=O) In Table A.

TABLE A

| Product | N | R (# carbon atoms) |
|---|---|---|
| 425N | 2.5 | 8-14 |
| 425LF | 2.5 | 8-14 (10 w/w % star-shaped alcohol added) |

TABLE A-continued

| Product | N | R (# carbon atoms) |
|---|---|---|
| 220UP | 2.5 | 8-10 |
| 225DK | 2.7 | 8-10 |
| 600UP | 2.4 | 12-14 |
| 215CSUP | 2.5 | 8-10 |

Other example nonionic surfactants include alcohol ethoxylates such as those available under the trade name LUTENSOL from BASF, Ludwigshafen, Germany. These surfactants have the general formula $C_{13}H_{25}/C_{15}H_{27}$—$(OC_2H_4)$n-OH (the alkyl group is a mixture of $C_{13}/C_{15}$). Other example surfactants include LUTENSOLA03 (n=3), AO8 (n=8), and AO10 (n=10). Other alcohol ethoxylates include secondary alkanols condensed with $(OC_2H_4)$ such as Tergitol 15-S-12, a $C_{11}$-$C_{15}$ secondary alkanol condensed with 12 $(OC_2H_4)$ available from Dow Surfactants. Another example nonionic surfactant is polyoxyethylene (4) lauryl ether. Amine oxides are also suitable. An example solid nonionic surfactant is powdered tallow fatty alcohol ethoxylate with 50 moles of EO sold as Genapol T-500P by Clariant. In some examples, the solid nonionic surfactants may help to control dissolution rates in water and also help adhesion to a surface.

Useful cationic surfactants may include, for example, primary amine salts, diamine salts, and quaternary ammonium salts. Useful amphoteric surfactants may include alkyl aminopropionic acids, alkyl iminopropionic acids, imidiazoline carboxylates, alkylbetaines, sulfobetaines, and sultaines. In certain examples, inert filler can be added to the cleaning block, for example to achieve adequate density and to keep costs to the minimum. If present, the filler may be included in the cleaning block at levels up to 60 wt. %, in some examples up to 40 wt. %, and in still others up to 25 wt. %. The filler may comprise inert salts, such as water-soluble inorganic or organic salts (or mixtures of such salts). Examples include various alkali metal and/or alkaline earth metal sulfates, chlorides, borates, and citrates. Specific inert salts include sodium sulfate, calcium sulfate, sodium chloride, potassium sulfate, sodium carbonate, lithium chloride, tripotassium phosphate, sodium borate, potassium fluoride, sodium bicarbonate, calcium chloride, magnesium chloride, sodium citrate, magnesium sulfate and sodium fluoride.

The cleaning block may include an alcohol. If present, the alcohol may be included in the cleaning block at levels up to 25 wt. %, in certain embodiments up to 15 wt. %, and in various examples up to 10 wt. %. One example alcohol is Neodol 23 marketed by Shell Oil Company. It is a mixture of $C_{12}$ and $C_{13}$ linear primary alcohols. As alternatives, it is believed that any linear (unbranched) primary fatty alcohol of less than $C_{21}$ and greater than $C_8$ (and mixtures thereof will also be suitable. Examples are 1-dodecanol; EPAL-16 (by Ethyl Corporation) which is a mixture of decanol, dodecanol, tetradecanol, and octadecanol; and ALFOL 1214 (by Vista Chemical Co.) which is a mixture of dodecanol and tetradecanol. Another example alcohol is glycerin. In certain examples, the alcohol may help control solution rates in water and help adhesion to a surface. A fragrance can also be added, depending on the type of aroma that is to be imparted. If present, the fragrance may be included in some example of the cleaning block at levels up to 25 wt. %, in certain examples to 15 wt. %, and in still other examples up to 10 wt. %. For instance, pine, citrus and potpourri scents can be employed. In some examples, any fragrance oils are essentially insoluble in water. Fragrance oils have the added advantage of, in some examples, facilitating extrusion of the cleaning blocks during manufacture.

A colorant is also optionally included in the cleaning block. If present, in some examples the colorant may be included in the cleaning block at levels up to 10 wt. %. The choice of the colorant will largely depend on the color desired for the water into which the cleaning block composition is to be dispensed. A binder may be used in the cleaning block to help maintain cleaning block integrity. If present, in some examples the binder may be included in the cleaning block at levels up to 25 wt. %, in certain examples up to 15 wt. %, and in still other examples up to 10 wt. %. In some examples the binder comprises the hydrated cellulose materials of U.S. Pat. No. 4,722,802, such as hydroxy alkyl cellulose (especially hydroxy ethyl cellulose or hydroxy propyl cellulose). Gum binders may also be used. Examples are guar, xanthan, tragacanth, carrageenan, karaya, or algin. The cleaning block may also include a chlorine releasing agent. If present, in some example the chlorine releasing agent is included in the cleaning block at levels up to 40 wt. %, in others up to 25 wt. %, and in still others up to 10 wt. %. Non-limiting examples of a chlorine releasing agent include chloroisocyanuric acids (trichloroisocyanuric acid and dichloroisocyanuric acid), chloroisocyanurates, hypochlorites, chlorosuccinimides, chloramine T (sodium para-toluene sulfochlorine), and halogenated hydantoins (e.g., chlorodimethyl hydantoins).

A lime-scale removing agent may also be present in the cleaning block. If present, in some examples the lime-scale removing agent is included in the cleaning block at levels up to 40 wt. %, in others up to 15 wt. %, and in still others up to 10 wt. %. Example lime-scale removing agents include, but are not limited to, organic and inorganic acids such as citric acid or sulfamic acid. A hydrotrope may also be present in the cleaning block to assist in blending of surfactants and other liquids. If present, in some examples the hydrotrope is included in the cleaning block at levels up to 25 wt. %, in various examples up to 15 wt. %, and in still other examples up to 10 wt. %.

Example anionic hydrotropes are alkali metal salts of aromatic sulfonates. An example hydrotrope is sodium xylene sulfonate such as "Stepanate SXS" available from Stepan Chemicals. Other exemplary hydrotropes include sodium butyl monoglycol sulfate, sodium toluene sulfonate and sodium cumene sulfonate.

A solvent may also be present in the cleaning block to assist in blending of surfactants and other liquids. If present, in some examples the solvent is included in the cleaning block at levels up to 25 wt. %, in various examples up to 15 wt. %, and in still other examples up to 10 wt. %. Example solvents include aliphatic alcohols of up to 8 carbon atoms; alkylene glycols of up to 6 carbon atoms; polyalkylene glycols having up to 6 carbon atoms per alkylene group; mono- or dialkyl ethers of alkylene glycols or polyalkylene glycols having up to 6 carbon atoms per glycol group and up to 6 carbon atoms in each alkyl group; and mono- or diesters of alkylene glycols orpolyalkylene glycols having up to 6 carbon atoms per glycol group and up to 6 carbon atoms in each ester group. Specific examples include t-butanol, t-pentyl alcohol; 2,3-dimethyl-2-butanol, benzyl alcohol or 2-phenyl ethanol, ethylene glycol, propylene glycol, dipropylene glycol, propylene glycol mono-n-butyl ether, dipropylene glycol mono-n-butyl ether, propylene glycol mono-n-propyl ether, dipropylene glycol mono-n-propyl ether, diethylene glycol mono-n-butyl ether, diethylene glycol monomethyl ether, dipropylene glycol monomethyl ether, triethylene glycol, propylene glycol monoacetate, glycerin, ethanol, isopropanol, and dipropylene glycol monoacetate. In certain embodiments, the solvent is dipropylene glycol.

A chelating agent may also be present in the cleaning block. If present, in some examples the chelating agent is included in the cleaning block at levels up to 25 wt. %, in various examples up to 15 wt. %, and in still other examples up to 10 wt. %. Example chelating agents include ethylenediaminetetraacetic acid (EDTA), trisodium nitrilotriacetate, sodium tripolyphosphate, acrylics, maleic anhydride acrylic copolymers, gluconates, sorbitols, trizaoles, phosphonates, and salts of the foregoing. The cleaning block may include a dispersing agent such as a polymer. In certain embodiments, the dispersing agent may be selected from the group consisting of a polyacrylic acid and alkali metal salts of polyacrylic acid. If present, in certain examples the dispersing agent is included in the cleaning block at levels up to 25 wt. %, in other examples up to 15 wt. %, and in various embodiments up to 10 wt. %. In some embodiments, the polymer is homopolymer sodium polyacrylate. One example version is sold by Rohm & Haas Co. as Acusol 445 ND with a molecular weight of 4,500. Other example polymers include potassium polyacrylate and polyacrylic acid itself.

Other additives that can be included in the cleaning block are other cleaning agents (e.g. borax) and/or preservatives (e.g. Dow Chemical's Dowicil® 75). One example block includes: (i) 39-86% (in some examples, 85%) Ufaryl DL 85CJ (solid sodium dodecyl benzene sulfonate 85%), (ii) 0-8% (in some examples, 8%) Glucopon 425N (nonionic surfactant: an alkylpolyglucoside) surfactant with an alkyl group containing from 8 to 16 carbon atoms and having an average degree of polymerization of 1.6, (iii) 0-6% glycerine 99% (in some examples, 2%), (iv) 0-50% sodium sulfate (in some examples, 0%), and (v) 5-8% fragrance (in some examples, 5%). Another example block includes: (i) about 35 wt. % powdered nonionic fatty alcohol ethoxylate surfactant; (ii) about 20 wt. % powdered anionic sodium Lauryl sulfate surfactant; (iii) about 5 wt. % liquid nonionic alcohol ethoxylate surfactant; (iv) about 39 wt. % citric acid; and (v) about 1 wt. % fragrance.

Yet another example block includes: (i) about 65 wt. % of Ufaryl DL85CJ solid anionic alkyl aryl sulfonate; (ii) about 0.0020 wt % of dye; (iii) about 8.5000 wt % Glucopon 425N nonionic, alkyl polyglycoside; (iv) about 0.5000 wt % glycerine; (v) about 19.9980 wt % sodium sulfate; and (vi) about 6.0000 wt % fragrance. Still another example block includes: (i) about 65 wt. % of solid anionic sodium Lauryl sulfate; (ii) about 0.0020 wt % of dye; (iii) about 8.5000 wt % Glucopon 425N nonionic, alkyl polyglycoside; (iv) about 0.5000 wt % glycerine; (v) about 19.9980 wt % sodium sulfate; and (vi) about 6.0000 wt % fragrance.

Still another example block includes: (i) about 60 wt. % of Ufaryl 85CJ solid anionic alkyl aryl sulfonate; (ii) about 8.5000 wt. % Glucopon 425N nonionic, (iii) about 17.9970 wt. % sodium sulfate; (iv) about 5.0000 wt. % calcium carbonate, (v) about 0.0030 wt % of dye; (vi) about 5.0000 wt. % fragrance; and (viii) about 1.000 wt. % of Mirapol Surf-500. Yet another example block includes: (i) about 60 wt. % of Ufaryl 85CJ solid anionic alkyl aryl sulfonate; (ii) about 8.5000 wt. % Glucopon 425N nonionic, (iii) about 17.9998 wt. % sodium sulfate; (iv) about 5.0000 wt. % calcium carbonate, (v) about 0.0020 wt % of dye; (vi) about 5.0000 wt. % fragrance; and (viii) about 1.000 wt. % of Mirapol Surf-500.

And yet another example block includes: (i) about 60-65 wt. % of Ufaryl 85CJ solid anionic alkyl aryl sulfonate; (ii) about 9.5000-10.0000 wt. % Glucopon 425, (iii) about 17.9970-25.2800 wt. % sodium sulfate; (iv) about 0.5000 wt. % glycerine, (v) about 0.0200 wt. % of Bitrex Solution 25% (in Propylene Glycol); and (vi) about 5.0000-7.0000 wt. % fragrance.

The appropriate percentages to be used for the ingredients of the disintegrating block are, in some embodiments, dependent not only to provide a ultimately-formed disintegrating block that has a "sticky" consistency, but also in some examples for the ingredients to be sufficiently moist to pass through an extruder, although not completely wet, so that the disintegrating blocks may retain a block shape and may be storable in a dry form. In a method example for using the cleaning article, the first surface of a cleaning block is pressed to a surface above any waterline in a position that may be contacted by a rinse liquid that disintegrates the cleaning block. Rinse liquid may then be allowed to contact the cleaning block such that an amount of the cleaning block is mixed with rinse fluid to clean the surface or a liquid reservoir adjacent the surface.

Since the product in certain embodiments is essentially solid-like, its viscoelastic properties may be measured using techniques such as a penetrometer and/or appropriate rheometric techniques. Once the viscoelastic properties are determined, a range can be established for the rheology of the product that can lead to good adhesion. Therefore, in some examples the material has a certain hardness or malleability for optimal adhesion to the ceramic or other hard surfaces. Using the "Hardness Test" method described below, the hardness in some embodiments measures between 20 and 160 tenths of a millimeter penetration, and in certain examples between 50 and 120 tenths of a millimeter penetration, and in still other examples between 70 and 100 tenths of a millimeter penetration. In certain examples, the block material has a certain stickiness for optimal adhesion to the ceramic or other hard surfaces. Using the "Stickiness Test" method below, in some examples the stickiness of the waxed paper to the cleaning block measures at least 5 grams, and in some examples at least 20 grams, and in still other examples at least 40 grams. The stickiness of the cleaning block to the waxed surface in some examples measures at least 50 grams, and in other examples at least 60 grams, and in still other examples at least 80 grams.

Amongst other characteristics, in some examples the resulting block adheres to a toilet bowl even after multiple flushes. Although one intended use of this block is toilet cleaning and/or freshening, it is contemplated that this technology could also be used in other applications (e.g., outdoor windows or any other location where water will pass over as a rinse liquid). In certain embodiments, after a number of toilet flushes the block dissolves down and when there is not much left, the remainder may be used with a standard toilet brush to clean the toilet.

One can measure how long the block lasts (number of days with a controlled number of flushes/day.) The thickness of the block influences how long the block lasts, but the softness may limit how thin it can be cut (for example, if it were chilled, e.g., by cold air before cutting, the block may be cut thinner). For a fragranced toilet block, in some examples the solubility of the block is such that about 0.01 grams of fragrance are released per flush (calculated by dividing the weight of fragrance in the block by the number of flushes required to dissolve the block), in others it is about 0.02 grams, in others about 0.005 grams, and in still others about 0.025 grams. In certain examples, the solubility of the block is such that between about 0.01 and 0.02 grams of fragrance are released per flush (calculated by dividing the weight of fragrance in the block by the number of flushes required to dissolve the block), in others between about 0.0075 and 0.0125 grams, in certain others between about 0.01 and 0.015 grams, and in still others between about 0.005 and 0.025 grams.

In some examples, the resulting block may be very soluble (dissolve readily in the flush water) so it will release more actives and fragrance faster. However, the ratio of ingredients may be modified to achieve the desired solubility. For example, adding more fragrance tends to decrease the solubility so the block lasts longer.

Hardness Test

The method used to assess the hardness of a cleaning block is referred to herein as the "Hardness Test." The hardness measurement is in tenths of a millimeter penetration into the surface of an extrudate. Therefore, a measurement of 150 is a penetration of 150 tenths of a millimeter, or 15 millimeters. The equipment used for this example was a Precision Penetrometer (Serial #10-R-8, Manufactured By Precision Scientific Co., Chicago, Ill., USA) equipped with a large diameter cone weighing 102.4 grams with a 23 D angle, and loaded with 150 grams of weight on the top of the spindle. The test method steps were: (1) Sample must be at least ¼ inch thick. (2) Place sample on the table of the instrument. (3) Both top and bottom surfaces of the test sample should be relatively flat. (4) Set scale on instrument to ZERO and return cone and spindle to the upward position and lock. Clean any residual material off the cone and point before resetting for the next reading. (5) Using hand wheel, lower the complete head of the instrument with cone downward until the point of the cone touches the surface of the sample. (6) Recheck the ZERO and pinch the release of the cone and spindle. (7) Hold the release handle for the count of 10 seconds and release the handle. (8) Read the dial number and record. (9) Repeat steps 4-8 three times at different locations on the surface of the test sample. (10) Add the 3 recorded numbers and divide by 3 for the average. This result is the hardness of the tested sample. With this "Hardness Test," a higher number indicates a softer product because the units of hardness are in tenths of a millimeter in penetration using the test procedure delineated above. If the cleaning block is too soft (i.e., a high hardness number), then it may be more difficult to manufacture into shapes such as blocks because the product may be too malleable. If the product is too hard (i.e., a low hardness number), then more pressure may be required to push the cleaning block onto the surface, and some stickiness may be lost. In some examples, such as cleaning blocks to be applied to a dry surface, the cleaning block has a hardness of about 20 to about 160 tenths of a millimeter penetration. In certain of the examples, for example a cleaning block that will be applied to a wet surface, the hardness is greater than 50 tenths of a millimeter penetration.

Stickiness Test

The method used to assess the level of stickiness of a cleaning block is referred to herein as the "Stickiness Test." The equipment used was: (1) a balance that weighs out to two decimal places and at least 3600 grams; (2) a strip of the product about 0.75 inches wide, 3 inches long, and 0.25 inches thick; (3) a strip of waxed paper about 1 inch wide by 4 inches long; and (4) a 4 inch square ceramic tile. The test method steps were as follows: (1) Take the strip of product and place it on the middle of the weighing plate of the balance. (2) Take the strip of waxed paper and place it on the strip of product. (3) Use your finger or thumb to lightly run over the surface of the waxed paper so it is in contact with the product. (4) Place the tile on 15 top of the waxed paper so that it is centered. (5) Zero the balance and then press slowly and evenly on the tile until 2000 grams of pressure/weight is achieved. (6) Remove the tile, and zero out the balance. (7) Remove the strip of waxed paper from the product, recording the negative weight range achieved during removal. (8) Remove the strip of product from the ceramic tile, recording the negative weight range achieved during removal.

Example 1

The following experiment was conducted to assess the utility of a disintegrating block used as an under-the-toilet-rim type product by sticking the block directly onto a wall of a toilet bowl. The disintegrating block used in this example was formed by using the following components: (1) Ufaryl DL80CW-50.00 weight %; (2) Sodium Sulfate-38.50 weight %; (3) Neodol2-5.00 weight %; and (4) Fragrance-6.50 weight %. Dye was also added in a very small amount. Ufaryl DL80 CW is sodium dodecyl benzene sulfonate. Neodol23 is a 12-carbon and 13-carbon blend of linear fatty alcohols. All of the above-noted components were mixed until a uniform damp powder or agglomerate mixture was formed. The damp powder was then extruded using a sigma Lab extruder. The product was passed once through the noodle stage of the extruder, and three times through final extrusion. After the noodle stage, the product came out in the form of spaghetti. After final extrusion, the product was in the form of a very uniform log, with a slight translucent appearance. Extrusion was conducted through a nose cone without the use of a die. Following extrusion, the log was cut into disks using a flying knife, such that each disk weighed about 20 to 25 grams.

Once prepared, the performance of the disks formed by the method described above was tested in a toilet bowl. The disk was pressed onto the surface of the inside of the toilet bowl, above the water line. Initial flushing did not cause the disk to fall off. The flushing continued to dissolve the disk. Products were flushed for two weeks, and the product did not fall off during use.

Example 2

Disintegrating blocks were formed using the components listed in the following Tables 1, 2, 3 and 4 wherein all numbers are weight percentages of the total composition of the block. In the Tables, a "yes" under "Stick, wet" or "Stick, dry" indicates that the cleaning block sticks to a wet or dry surface, respectively, upon being pressed firmly to the surface.

TABLE 1

| | Formula Number | | | | | | | | |
|---|---|---|---|---|---|---|---|---|---|
| Component | 1 wt. % | 2 wt. % | 3 wt. % | 4 Wt. % | 5 wt. % | 6 wt. % | 7 wt. % | 8 wt % | 9 Wt. % |
| Ufaryl DL85CJ anionic alkyl aryl sulfonate | 90 | 90 | 90 | 90 | 90 | 90 | 89 | 88 | 87 |
| Tergitol 15-S-12 nonionic, $C_{11}$-$C_{15}$ secondary alkanol condensed with 12 EO | 2.5 | | | | 2.5 | 5 | | | |
| Glucopon 425N nonionic, alkyl polyglycoside | 2.5 | 2.5 | | 5 | | | 6 | 7 | 8 |
| Acusol 445N Polyacrylate | | 2.5 | 5 | | 2.5 | | | | |
| Fragrance | 5 | 5 | 5 | 5 | 5 | 5 | 5 | 5 | 5 |
| Hardness per the "Hardness Test" (Tenths of a millimeter of penetration) | 44 | 36 | 32 | 46 | 47 | 27 | 54 | 64 | 72 |

TABLE 2

| | Formula Number | | |
|---|---|---|---|
| Component | 10 wt. % | 11 wt. % | 12 wt. % |
| Ufaryl DL85CJ anionic alkyl aryl sulfonate | 90 | 87 | 85 |
| Stepanate - sodium xylene sulfonate anionic hydrotrope | 5 | 8 | 10 |
| Fragrance | 5 | 5 | 5 |
| Hardness per the "Hardness Test" (Tenths of a millimeter of penetration) | 46 | 56 | 62 |

TABLE 3

| | Formula Number | | | |
|---|---|---|---|---|
| Component | 13 wt. % | 14 wt. % | 15 wt. % | 16 wt. % |
| Ufaryl DL85CJ anionic alkyl aryl sulfonate | 36 | 39 | 86 | 89 |
| Tergitol 15-S-12 nonionic, $C_{11}$-$C_{15}$ secondary alkanol condensed with 12 EO | 6 | 6 | 6 | 6 |
| Sodium Sulfate filler | 50 | 50 | | |
| Fragrance | 8 | 5 | 8 | 5 |
| Hardness per the "Hardness Test" | 125 | 45 | — | 4 |
| Stick, wet Rectangular Shape | Yes | Yes | dnt | No |
| Stick, dry Rectangular Shape | Yes | Yes | dnt | Yes |

dnt = did not test

TABLE 4

| Component | Formula Number 17 wt. % | 18 wt. % | 19 wt. % | 20 Wt. % | 21 wt. % | 22 wt. % | 23 wt. % | 24 wt. % | 25 wt. % | 16 wt. % |
|---|---|---|---|---|---|---|---|---|---|---|
| Ufaryl DL85CJ anionic alkyl aryl sulfonate | 40 | 40 | 39 | 39 | 39 | 39 | 86 | 85 | 36 | 39 |
| Glucopon 425N nonionic, alkyl polyglycoside | | 2 | | 3 | 1.5 | 6 | 8 | 8 | | |
| Sodium Sulfate filler | 50 | 50 | 50 | 50 | 50 | 50 | | | 50 | 50 |
| Quest Fuzzy Lime fragrance | 8 | 8 | 8 | 8 | 8 | 5 | 5 | 5 | 8 | 5 |
| Hardness per the "Hardness Test" (Tenths of a millimeter of penetration) | 23 | 45 | 47 | 100 | 77 | 48 | 51 | 65 | 157 | 81 |
| Stick, wet Round Shape | dnt | dnt | dnt | dnt | dnt | Yes | Yes | Yes | dnt | dnt |
| Stick, dry Round Shape | Yes | Yes | Yes | Yes | Yes | dnt | dnt | dnt | dnt | dnt |
| Stick, wet Rectangular Shape | Yes | Yes | Yes | Yes | Yes | Yes | Yes | Yes | Yes | Yes |
| Stick, dry Rectangular Shape | Yes | Yes | Yes | Yes | Yes | dnt | dnt | dnt | Yes | Yes |
| 10 gm. @ 15 flushes per day Round Shape Life in days | 297 | 297 | >222 | 297 | >481 | >209 | <123 | <194 | dnt | dnt |
| 10 gm. @ 15 flushes per day Rectangular Shape Life in days | >117 | >117 | >117 | >117 | >117 | >209 | <194 | <104 | >225 | >225 |

dnt = did not test

Example 3

Disintegrating blocks were formed using the components listed in the following Table 5 wherein all numbers are weight percentages of the total composition of the block.

TABLE 5

| Component | Formula Number 27 wt. % | 28 wt. % |
|---|---|---|
| Ufaryl DL85CJ anionic alkyl aryl sulfonate | 31.8380 | 61.0000 |
| Dye | 0.0050 | 0.0020 |
| Glucopon 425N nonionic, alkyl polyglycoside | | 7.5000 |
| Glycerine | 1.5000 | 0.5000 |
| Isocer A 04 Paraffin Wax | 4.9747 | |
| Sodium Sulfate filler | 53.7228 | 24.9980 |
| Fragrance | 7.9595 | 6.0000 |
| Hardness per the "Hardness Test" (Tenths of a millimeter of penetration) | 25 | 87 |
| Stickiness per the "Stickiness Test" (Grams) | >50 | >80 |

A "Hardness Test" and a "Stickiness Test" were run with samples prepared using Formula Nos. 27 and 28 to show the hardness and the stickiness. Formula 27 had a hardness rating of 25 tenths of a millimeter of penetration. The range of force to remove the waxed paper ranged from 5 to 20 grams. The range of force needed to remove the product was more than 50 grams as the tray actually lifted away from the balance before it eventually became dislodged. Formula 28 had a hardness rating of 87 tenths of a millimeter of penetration. The range of force to remove the waxed paper ranged from 10 to 40 grams. The range of force needed to remove the product was more than 80 grams as the tray actually lifted even further away from the balance before it eventually became dislodged. Thus, in some examples, a self-sticking disintegrating cleaning block can be directly attached to the wall of a toilet bowl or urinal just above the water-line by pressing the block to the wall of the toilet bowl or urinal. When the toilet or urinal is flushed, the cleaning block is rinsed with water, this intermittent rinsing of the cleaning block causes the cleaning block to disintegrate slowly and to release active ingredient. Despite the intermittent rinsing of the cleaning block, the cleaning block may remain firmly attached to the wall, and may remain so attached for several weeks. Eventually, the cleaning block may disintegrate completely such that there is no longer a cleaning block on the wall of the toilet bowl or urinal. At this point, one can place a new cleaning block on the wall of the toilet bowl or urinal. While in certain examples the block is used for cleaning a toilet bowl or urinal, it is also useful in cleaning, disinfecting and/or deodorizing any surface that is contacted with a rinse liquid.

In some examples the cleaning block is an ultra-high viscosity gel, a solid, or a malleable solid. In certain of these embodiments, the composition of the block comprises an ethoxylated alcohol, an alkyl polyglycol ether, mineral oil, an alcohol, polyethylene glycol, an alkyl ether sulfate salt and water. In certain embodiments of these embodiments, the composition further includes an adhesion promoter, which may comprise one or more of an ethoxylated alcohol, an alkyl polyglycol ether, polyethylene glycol, and/or a hydrophilic polymer. In certain embodiments, the adhesion promoter is present from about 18 wt. % to about 80 wt. %. In various examples, the adhesion promoter causes a bond with water and gives the composition a dimensional stability under action of rinse water. In certain examples the composition is self-adhering to a hard surface upon application thereto and provides a wet film on said hard surface when water passes over said composition and hard surface. In various examples, the composition further comprises at least one additional nonionic surfactant and/or at least one active agent, wherein said active agent may be one or more of a fragrance, germicide, antimicrobial, bleach, or deodorizer. In certain examples the adhesion promoter is present in an amount of about 18 wt. % to about 27 wt. %. In various embodiments the mineral oil is present in an amount of greater than 0 to about 5 wt. %, and in others in an amount of about 0.5 wt. % to about 3.5 wt. %. In some examples the alcohol is present in an amount of greater than 0 to about 5 wt. %. In some examples, the polymer is present in an amount of about 1 wt. % to about 10 wt. %.

In accordance with examples of one aspect, a self-adhering cleaning block may include a first surface configured to adhere to a surface desired to be cleaned, a second surface opposite the first surface, and a handle extending out from a part of the second surface is disclosed, where the material composition of the block may be essentially uniform, and where the material composition of the block may further comprise a non-ionic surfactant, and a liquid component. In some examples, the material composition of the block further comprises a solid anionic surfactant. The block can be configured to be applied to a surface desired to be cleaned without the use of an applicator. In accordance with examples of another exemplary aspect, a cleaning article including a self-adhering cleaning block is disclosed. In accordance with embodiments of another exemplary aspect, a method is disclosed, where in certain examples the method comprises mixing a non-ionic surfactant and a liquid component to form a cleaning composition, where the cleaning composition is essentially uniform, and then extruding, pressing or casting the cleaning composition to form a cleaning block, such that the cleaning block comprises a first surface, a second surface opposite the first surface, and a handle extending out from a part of the second surface. In some examples, the cleaning composition is formed by mixing a solid anionic surfactant with the non-ionic surfactant and the liquid component. The surface desired to be cleaned can be a toilet surface on a toilet and 0.01 grams of fragrance can be released per flush of the toilet.

In some embodiments, the block is extruded, pressed, or cast into a final shape having the first surface, the second surface, and the handle. In various examples, the handle has a handle height measured between a portion of the second surface adjacent to the handle and a top portion of the handle, and the handle height is about 0.20 inches or more. In some embodiments the block has a block height measured between a bottom portion of the first surface and a top portion of the handle, and the block has a block width measured between a first side of the first surface and a second side of the first surface. In certain examples, the ratio of the block height to block width is between about 1:4 and about 4:1. In some examples the height of the block is about 0.20 inches or more. In various examples, the block further comprises a plurality of projections extending out of the first surface.

In some examples, a self-adhering agent or cleaning block that does not utilize a disposable applicator, but at the same time allows the user to apply the block without bringing their hand into close proximity to the surface of a toilet is provided.

In accordance with another exemplary aspect, a cleaning article is disclosed. In some examples, the article comprises a self-adhering cleaning block, the cleaning block comprising a first surface, a second surface opposite the first surface, and a handle extending out from a part of the second surface. In various embodiments, the material composition of the article block is essentially uniform and comprises a non-ionic surfactant and a liquid component. In various examples, the material composition of the article block further comprises a solid anionic surfactant. In some examples, the cleaning article further comprises a barrier layer covering at least a portion of the handle of the cleaning block. In certain embodiments, the barrier layer is releasably adhered to the at least a portion of the handle, such that a user may remove the barrier layer after applying the self-adhering cleaning block to a surface to be cleaned. In various examples, the barrier layer comprises one or more water soluble materials.

In accordance with another exemplary aspect, a method is disclosed. In some embodiments, the method comprises a non-ionic surfactant and a liquid component to form a cleaning composition, wherein the cleaning composition is essentially uniform, and then extruding, pressing or casting the cleaning composition to form a cleaning block, such that the cleaning block comprises a first surface, a second surface opposite the first surface, and a handle extending out from a part of the second surface. In some examples, the cleaning composition is formed by mixing a solid anionic surfactant with the non-ionic surfactant and the liquid component.

In certain examples of the method, the cleaning composition is extruded through a die or cone to form a log, and the method further comprises cutting the log into multiple sections to form a plurality of cleaning blocks. In various embodiments, the method further comprises releasably adhering a barrier layer to at least a portion of the handle. In some examples, the method further comprises coating at least a portion of the handle with a barrier layer comprising one or more water soluble materials. In certain embodiments, the method further comprises enclosing one or more cleaning blocks in a product package.

In another example, a cleaning article may include a self-adhering cleaning block. The cleaning block can include a block body having a first surface and a second surface opposite the first surface and a handle extending out from a part of the second surface. The block body and the handle can have the same material composition. The material composition of the block body and the handle can include a non-ionic surfactant, and a liquid component. In various examples, the material composition of the block body and handle further includes a solid anionic surfactant. The block body and the handle are extruded, pressed, or cast together into a final shape. The cleaning block may also include a plurality of projections extending out of the first surface.

In another example a self-adhering cleaning block, can include a body portion having a first surface configured to adhere to a surface desired to be cleaned and a grasping portion configured to be grasped by the user to adhere the block to the surface desired to be cleaned. The cleaning block can be formed of a non-ionic surfactant and a liquid component. The cleaning block may be formed to also include a solid anionic surfactant. The grasping portion extends from the body portion, and the grasping portion is uniformly shaped as part of the body portion. A cross-section of the body portion can be formed of one of a triangle, semi-circle, or semi-oval.

In another example, a method of applying a self-cleaning material to a surface may include removing the self-cleaning material from a package by grasping the handle, placing the first surface into contact with a surface desired to be cleaned to adhere the self-cleaning material to the surface without the use of an applicator, and rinsing the surface. In the method, the self-cleaning material can include a block having a first surface, a second surface and a handle extending from the second surface, and the material composition of the block can include a non-ionic surfactant, and a liquid component. The material composition of the block may further include a solid anionic surfactant.

This disclosure is not limited to the disclosed embodiments. To the contrary, the present disclosure is intended to cover various modifications and equivalent arrangements.

INDUSTRIAL APPLICABILITY

The disclosure herein provides self-adhering cleaning blocks, cleaning articles and methods of making a self-adhering cleaning blocks and/or cleaning articles. The example cleaning blocks, articles and methods may, in certain examples, be used to clean a surface, such as a toilet surface.

The invention claimed is:

1. A cleaning article comprising:
- a self-adhering cleaning block, the cleaning block comprising:
- a first surface;
- a second surface opposite the first surface; and
- a handle integrally formed with and extending out from a part of the second surface;
- the first surface, second surface, and handle forming a unitary structure having an uniform material composition, wherein the material composition of the block comprises:
  - a non-ionic surfactant; and
  - a liquid component.

2. The cleaning article of claim 1, wherein the block is extruded, pressed, or cast into a final shape having the first surface, the second surface, and the handle.

3. The cleaning article of claim 1, wherein the handle has a handle height measured between a portion of the second surface adjacent to the handle and a top portion of the handle, and wherein the handle height is about 0.20 inches or more.

4. The cleaning article of claim 1, wherein the cleaning block has a block height measured between a bottom portion of the first surface and a top portion of the handle, wherein the cleaning block has a block width measured between a first side of the block and a second side of the block, and wherein the ratio of the block height to block width is between about 1:4 and about 4:1.

5. The cleaning article of claim 1, wherein the block height is about 0.20 inches or more.

6. The cleaning article of claim 1, wherein the cleaning block further comprises a plurality of projections extending out of the first surface.

7. The cleaning article of claim 1, further comprising a barrier layer covering at least a portion of the handle of the cleaning block.

8. The cleaning article of claim 7, wherein the barrier layer is releasably adhered to the at least a portion of the handle, such that a user may remove the barrier layer after applying the self-adhering cleaning block to a surface to be cleaned.

9. The cleaning article of claim 7, wherein the barrier layer comprises one or more water soluble materials.

10. The cleaning article of claim 1, wherein the material composition of the block further comprises a solid anionic surfactant.

11. A cleaning article comprising:
- a self-adhering cleaning block, the cleaning block comprising:
- a block body having a first surface and a second surface opposite the first surface;
- a handle integrally formed with and extending out from a part of the second surface;
- the block body and the handle having the same material composition, wherein the material composition of the block body and the handle comprises:
  - a non-ionic surfactant; and
  - a liquid component.

12. The cleaning article of claim 11, wherein the block body and the handle are extruded, pressed, or cast together into a final shape.

13. The cleaning article of claim 11, wherein the cleaning block further comprises a plurality of projections extending out of the first surface.

14. The cleaning article of claim 11, wherein the material composition of the block body and the handle further comprises a solid anionic surfactant.

* * * * *